US005482913A

United States Patent [19]

Satake et al.

[11] Patent Number: 5,482,913

[45] Date of Patent: Jan. 9, 1996

[54] RECORDING SHEET

[75] Inventors: Toshimi Satake; Tomoaki Nagai; Toshiyuki Takano; Akio Sekine, all of Tokyo, Japan

[73] Assignee: Nippon Paper Industries, Co., Ltd., Tokyo, Japan

[21] Appl. No.: 166,815

[22] Filed: Dec. 15, 1993

[30] Foreign Application Priority Data

Dec. 17, 1992 [JP] Japan ..... 4-336472

[51] Int. Cl.[6] ..... B41M 5/30

[52] U.S. Cl. ..... 503/210; 430/200; 430/201; 503/211; 503/212; 503/216; 503/225

[58] Field of Search ..... 427/150–152; 503/216, 217, 225, 210–212; 430/200, 201, 180

[56] References Cited

U.S. PATENT DOCUMENTS

| | | | |
|---|---|---|---|
| 4,439,512 | 3/1984 | Ceintrey | 430/180 |

FOREIGN PATENT DOCUMENTS

| | | | |
|---|---|---|---|
| 0520404 | 12/1992 | European Pat. Off. | 503/216 |
| 2655184 | 6/1977 | Germany | 503/216 |
| 60-184879 | 9/1985 | Japan | 503/216 |

OTHER PUBLICATIONS

Chemical Abstracts, vol. 118, No. 18, 3 May 1993, Columbus, Ohio, abstract No. 180127, p. 782 & JP–A–4–310 790 (Mitsubishi Paper Mills).

Patent Abstracts Of Japan vol. 10, No. 29 (M–451) (2086) 5 Feb. 1986 & JP–A 60–184 879 (Mitsubishi Seishi).

Chemical Abstracts, vol. 107, No. 8, 24 Aug. 1987, Columbus, Ohio, abstract No. 68275b, p. 617; JP–A–61 293 889 (Fuji Photo Film Co.).

Chemical Abhstracts, vol. 116, No. 20, 18 May 1992, Columbus, Ohio, abstract No. 204609d, p. 716 & JP–A–3 253 390 (Nicca Chemical Co.).

Jerry March 'Advanced Organic Chemistry 2. edition' McGraw–Hill, Tokyo 1977.

Abstract of Japanese laid–Open Publication 60–34892. Feb. 1985.

Abstract of Japanese Laid–Open Publication 60–184879. Sep. 1985.

Abstract of Japanese Laid–Open Publication 60–210491. Oct. 1985.

Abstract of Japanese Laid–Open Publication 63–137888. Jun. 1988.

Abstract of Japanese Laid–Open Publication 4–117351. Apr. 1992.

Abstract of Japanese Laid–Open Publication 4–144787. May 1992.

*Primary Examiner*—B. Hamilton Hess

*Attorney, Agent, or Firm*—Sherman and Shalloway

[57] ABSTRACT

A dispersion of a carbonate type blocked color developer having a hydroxyl group having a color developing function which is blocked by an O-substituted oxycarbonyl group (—(C=O)$OR_1$), and a metal salt of an organic acid or inorganic acid or a leuco dye are mixed to obtain an opaque undeveloped coating color, and the coating color is coated on paper or the like to obtain a recording sheet. Also, the coating color is further mixed with a light absorbent to obtain an opaque undeveloped coating color, which is coated on paper or the like to obtain an optical recording sheet.

19 Claims, No Drawings

RECORDING SHEET

FIELD OF THE INVENTION

This invention relates to a thermal recording sheet which is capable of recording by way of heat or light.

DESCRIPTION OF THE PRIOR ART

Thermal recording sheets used for facsimiles or the like comprise an opaque substrate such as paper coated thereon with coating color obtained by mixing and finely dispersing a colorless or pale colored electron-donating dye and a color developer in an aqueous solution of a water-soluble binder. However, these thermal recording sheets have been defective in that they tend to fog in undeveloped portions when stored in a high-temperature place or coming in contact with a solvent.

With the aim of eliminating such a disadvantage, Japanese Patent Publication Laid-open (Japanese OPI) 52-76118, Japanese OPI 60-184879, Japanese OPI 60-210491, Japanese OPI 63-137888, Japanese OPI 4-117351, and Japanese OPI 4-144787 disclosed a thermal recording material or a thermal recording sheet containing a urethane-type blocked color developer obtained by reacting a phenolic compound with an isocyanate compound.

These urethane-type blocked color developers are inactive at room temperature because a hydroxyl group having a color-developing function is chemically blocked but, when heated, decompose to the original color developer and the isocyanate compound to cause an electron-donating dye such as a leuco dye to develop a color. Therefore, a recording sheet using the color developer of this type does not develop a color unless a decomposition temperature is reached, nor does develop an unnecessary color (fogging) by heat or solvents.

Furthermore, Japanese OPI 60-34892 discloses use of a carbonate compound as a sensitizer.

However, recording sheets using a urethane-type blocked color developer have involved a problem in safety, because the color developer forms an isocyanate compound when decomposed by heating to develop a color, and have been insufficient in sensitivity.

Further, a carbonate compound is used merely as a sensitizer in combination with a color developer, and it has been unknown that a carbonate compound alone is used as a color developer.

OBJECT OF THE INVENTION

With a view to solve the above problems, a primary object of the present invention is to provide a recording sheet using a carbonate-type blocked color developer.

SUMMARY OF THE INVENTION

In accordance with the present invention, there is provided a recording sheet comprising an opaque recording layer containing a color developer of Formula (1) in which at least one of phenolic hydroxyl groups having a color-developing function is blocked by an O-substituted oxycarbonyl group (—(C=O)OR$_1$), and a metal salt of an organic acid or a metal salt of an inorganic acid or a leuco dye which reacts with the color developer to develop a color.

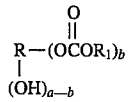

(1)

(wherein R denotes a substituted or unsubstituted $C_6$~$C_{30}$-aromatic ring. $R_1$ is substituted or unsubstituted $C_1$~$C_{18}$-alkyl group, substituted or unsubstituted $C_3$~$C_{15}$-cycloalkyl group, substituted or unsubstituted $C_1$~$C_{12}$-halogenated alkyl group, substituted or unsubstituted $C_1$~$C_{12}$-alkoxyalkyl group, substituted or unsubstituted $C_1$~$C_{12}$-silylalkyl group, vinyl group, allyl group, substituted or unsubstituted $C_7$~$C_{18}$-aryl alkyl group, substituted or unsubstituted $C_{13}$~$C_{25}$-diphenyl methyl group, substituted or unsubstituted $C_{19}$~$C_{35}$-triphenyl methyl group, substituted or unsubstituted $C_6$~$C_{20}$-aryl group, or substituted or unsubstituted $C_{10}$~$C_{20}$-naphthyl group, except 2,3,5-trimethylphenyl group, p-tert-butylphenyl group, and xylyl group. a and b are integers from 1 to 3, and a ≧b, provided, however, that a case is excepted where a-b-1 and a combination of R and $R_1$ is phenyl group and xylyl group, phenyl group and p-tert-butylphenyl group, phenyl group and p-diphenyl group, phenyl group and naphthyl group, or phenyl group and p-methoxycarbonylphenyl group.)

The color developer of Formula (1) used in the present invention, that is, a carbonate-type blocked color developer, can be produced by the following methods:

A first method is to add an alkyl chloroformate or an aryl chloroformate to a phenolic compound as a color developing compound in the presence of a base:

$$Ar—OH+ROC(=O)Cl \rightarrow ArOC(=O)OR$$

For example, when 4-hydroxy-4'-isopropylxydiphenyl sulfone is reacted with ethyl chloroformate in the presence of pyridine, a compound (12) can be obtained.

In a second method, a phenolic compound as a color developer is converted to an aryl chloroformate using phosgene or trichloromethyl chloroformate, and then an alcohol or phenol is added to the aryl chloroformate.

$$Ar—OH+ClC(=O)Cl \rightarrow ArOC(=O)Cl$$

$$ArOC(=O)Cl+ROH \rightarrow ArOc(=O)\ OR$$

Aryl chloroformates derived from phenolic compounds include the following:

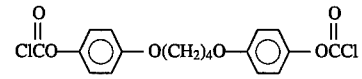

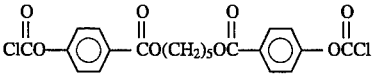

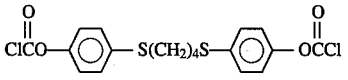

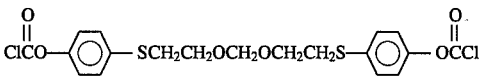

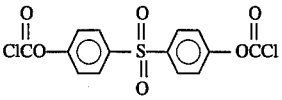

-continued

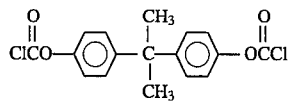

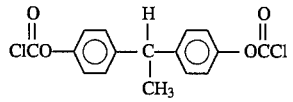

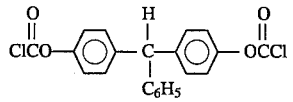

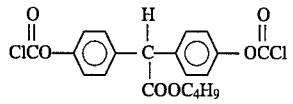

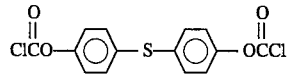

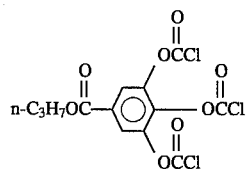

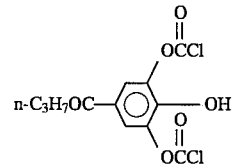

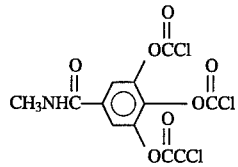

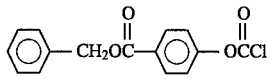

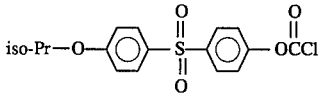

A third method is to react a dialkyldicarbonate compound with a phenolic compound as a color developer in the presence of a base:

$$ArOH+ROC(=O)OR \rightarrow ArOC(=O)OR$$

For example, when bisphenol S is reacted with di-tert-butyl dicarbonate in the presence of pyridine, a compound (20) can be obtained.

Phenolic compounds to be carbonated are: for example phenol, o-methylphenol, m-methylphenol, p-methylphenol, p-methoxyphenol, p-nitrophenol, p-chlorophenol, p-bromophenol, 3,4-dichlorophenol, p-tert-butylphenol, p-phenylphenol, 3-diethylaminophenol, 1-naphthol, 2-naphthol, methyl p-hydroxybenzoate, ethyl p-hydroxybenzoate, propyl p-hydroxybenzoate, isopropyl p-hydroxybenzoate, butyl p-hydroxybenzoate, benzyl p-hydroxybenzoate, 4-hydroxy-4'-isopropoxydiphenyl sulfone, 4-methyl-4'-hydroxydiphenyl sulfone, 4-hydroxy-4'-chlorodiphenyl sulfone, 4-hydroxy-4'-n-butoxy diphenyl sulfone, salicylic acid, ethyl salicylate, catechol, resorcinol, tert-butylcatechol, p,p'-biphenol, 4,4'-thiodiphenol, bis(4-hydroxyphenyl) sulfone, 4-methyl-3',4'dihydroxydiphenyl sulfone, 3,3'-diallyl-4,4'-dihydroxydiphenyl sulfone, 1,1-bis(p-hydroxyphenyl) propane, 1,1-bis(p-hydroxyphenol) cyclohexane, 2,2-bis(p-hydroxyphenyl) propane, 1,3-propyleneglycoldi(p-hydroxybenzoic ester), 1,4-butyleneglycoldi(p-hydroxybenzoic ester), hexyleneglycoldi(p-hydroxybenzoic ester), ethyleneglycoldi(p-hydroxyphenylether), hexyleneglycoldi(p-hydroxyphenylether), methyl bis(4-hydroxyphenol)acetate, ethyl bis(4-hydroxyphenyl)acetate, phenyl bis(4-hydroxyphenyl)acetate, pyrogallol, phloroglucinol, gallic acid, methyl gallate, ethyl gallate, n-propyl gallate, isoamyl gallate, lauryl gallate, and stearyl gallate.

The O-substituted oxycarbonyl group ($—(C{=}O)OR_1$) includes the following:

—(C=O)O—$CH_3$ methoxycarbonyl
—(C=O)O—$C_2H_5$ ethoxycarbonyl
—(C=O)O-n-$C_3H_7$ n-propoxycarbonyl
—(C=O)O-iso-$C_3H_7$ iso-propoxycarbonyl
—(C=O)O-n-$C_4H_9$ n-butoxycarbonyl
—(C=O)O-iso-$C_4H_9$ iso-butoxycarboxyl
—(C=O)O-sec-$C_4H_9$ sec-butoxycarbonyl
—(C=O)O-tert-$C_4H_9$ tert-butoxycarbonyl
—(C=O)O-n-$C_5H_{11}$ n-amyloxycarbonyl
—(C=O)O-n-$C_6H_{13}$ n-hexyloxycarbonyl
—(C=O)O-n-$C_7H_{15}$ n-heptyloxycarbonyl
—(C=O)O-n-$C_8H_{17}$ n-octyloxycarbonyl
—(C=O)O-n-$C_9H_{19}$ n-nonyloxycarbonyl
—(C=O)O-n-$C_{16}H_{33}$ n-hexadecyloxycarbonyl
—(C=O)O-n-$C_6H_{11}$ cyclohexyloxycarbonyl
—(C=O)O—$CHClCH_3$ 1-chloroethoxycarbonyl
—(C=O)O—$CH_2CH_2Cl$ 2-chloroethoxycarbonyl
—(C=O)O—$CH_2CH_2CCl_3$ 2,2,2-trichloroethoxycarbonyl
—(C=O)O—$CH_2CH_2OCH_3$ 2-methoxyethoxycarbonyl
—(C=O)O—$CH_2CH_2OC_2H_5$ 2-ethoxyethoxycarbonyl
—(C=O)O—$CH_2CH_2OC_4H_9$ 2-butoxyethoxycarbonyl
—(C=O)O—$CH_2CH_2CH(OCH_3)CH_3$ 3-methoxybutoxycarbonyl
—(C=O)O—$CH_2CH_2Si(CH_3)_3$ 2-(trimethylsilyl)ethoxycarbonyl
—(C=O)O—$CH_2CH_2SO_2CH_3$ 2-methylsulfonylethoxycarbonyl
—(C=O)O—$CH{=}CH_2$ vinyloxycarbonyl
—(C=O)O—$CH_2CH{=}CH_2$ allyloxycarbonyl
—(C=O)O—$CH_2CH_2OOCC(CH_3){=}CH_2$ 2-methacrylethoxycarbonyl
—(C=O)O—$CH_2C_6H_5$ benzyloxycarbonyl
—(C=O)O—$CH_2C_6H_4NO_2$ p-nitrobenzyloxycarbonyl
—(C=O)O—$CH(CH_3)C_6H_5$ α-methylbenzyloxycarbonyl
—(C=O)O—$C(CH_3)_2C_6H_5$ α,α-dimethylbenzyloxycarbonyl
—(C=O)O—$CH(C_6H_5)_2$ diphenylmethoxycarbonyl
—(C=O)O—$C(C_6H_5)_3$ triphenylmethoxycarbonyl
—(C=O)O—$C_6H_5$ phenoxycarbonyl
—(C=O)O—$C_6H_4NO_2$ p-nitrophenoxycarbonyl
—(C=O)O—$C_6H_4CH_3$ 3-methylphenoxycarbonyl
—(C=O)O—$C_6H_3(CH_3)_2$ 3,4-dimethylphenoxycarbonyl
—(C=O)O—$C_6H_3(CH_3)_2$ 3,5-dimethylphenoxycarbonyl
—(C=O)O—$C_6H_4$-sec-$C_4H_9$ 2-sec-butylphenoxycarbonyl
—(C=O)O—$C_{10}H_7$ naphethyloxycarbonyl Examples of the blocking group having two oxycarbonyl groups include the following:

—(C=O)O—$CH_2CH_2$—O(C=O)—
—(C=O)O—$(CH_2)_4$—O(C=O)—
—(C=O)O—$(CH_2)_6$—O(C=O)—
—(C=O)O—$(CH_2)_2O(CH_2)_2$—O(C=O)—

Since coloring temperature of the recording sheet of the present invention depends on a dissociation temperature of the blocked color developer, it is preferable that the blocked color developer has a low dissociation temperature. In view of dissociation temperature of the blocked color developer, it is preferable that the aromatic ring (R in Formula (1)) having blocked phenolic hydroxyl groups with a color developing function has an electrophilic substituent or residue. In other words, the aromatic ring having phenolic hydroxyl groups with a color developing function has an electrophilic substituent or residue, and at least one of the color developing phenolic hydroxyl groups is blocked by O-substituted oxycarbonyl group. That is, a color developer of Formula (2) is more preferable.

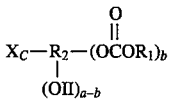

(2)

(wherein $R_1$, a and b are the same as those in Formula (1). $R_2$ denotes a substituted or unsubstituted $C_6$~$C_{30}$-aromatic ring, and c is an integer from 1 to 4. X is halogen atom, nitoro group, substituted or unsubstituted $C_1$~$C_{18}$-alklamino group, carboxyl group, —C(=O)OY, —C(=O)NHY, or —$SO_2$ Y, Y is substituted or unsubstituted $C_1$~$C_{18}$-alkyl group, substituted or unsubstituted $C_6$~$C_{20}$-aryl group, substituted or unsubstituted $C_6$~$C_{30}$-alkoxyaryl group, substituted or unsubstituted $C_6$~$C_{30}$-alkylcarbonyloxyaryl group, or substituted or unsubstituted $C_7$~$C_{18}$-arylalkyl group.)

Further, in view of the dissociation temperature, $R_1$ of the O-substituted oxycarbonyl group (—(C=O)$OR_1$) of Formulae (1) and (2) is preferable to be such that the cation is stable but easy to dissociate such as tertiary carbo-cation or benzyl-cation. Specifically, tert-butyl, benzyl, p-nitrobenzyl, α-nitrobenzyl, α-methylbenzyl, α,α-dimethylbenzyl, diphenylmethyl, or triphenylmethyl group is preferable. In addition, an electrophilic substituent or a substituent having an electrophilic substituent such as halogenated alkyl group (for example, chloromethyl group, dichloromethyl group, trichloromethyl group, trifuluoromethyl group, or trichloro methyl group) is also preferable. That is the following color developer of Formula (3) is more preferable.

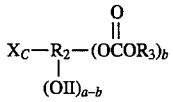

(3)

(wherein a and b are the same as those in Formula (1), and $R_2$, X, and c are the same as those in Formula (2). $R_3$ is tert-butyl group, substituted or unsubstituted $C_1$~$C_6$ halogenated alkyl group, benzyl group, p-nitorobenzyl group, α-methylbenzyl, α, α-dimethylbenzyl group, diphenylmethyl group, triphenylmethyl group.)

As the blocked color developer, Formulae (4), (5), (6), and (7) are more preferable.

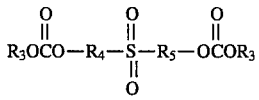

(4)

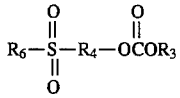

(5)

(wherein $R_4$ and $R_5$ denote a substituted or unsubstituted $C_6$~$C_{20}$-aromatic ring, and $R_4$ and $R_5$ may be the same or different. $R_3$ is the same as that in Formula (3). $R_6$ denotes substituted or unsubstituted $C_1$~$C_{18}$-alkyl group, substituted or unsubstituted $C_6$~$C_{30}$-alkylaryl group, substituted or unsubstituted $C_6$~$C_{30}$-alkoxylaryl group, substituted or unsubstituted $C_6$~$C_{30}$-halogenated aryl group, or substituted or unsubstituted $C_{10}$~$C_{30}$-naphthyl group.)

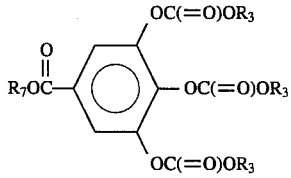

(6)

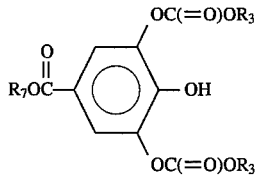

(7)

(wherein R 3 is the same as that in Formula (3). $R_7$ is substituted or unsubstituted $C_1$~$C_{20}$-alkyl group).

Practical examples of the carbonate type blocked color developer include those compounds as described in Japanese OPI 5-177950.

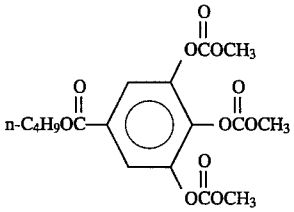

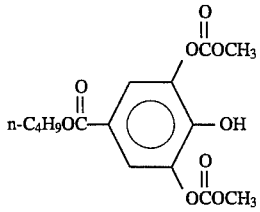

-continued
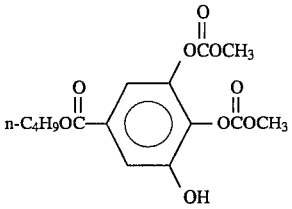
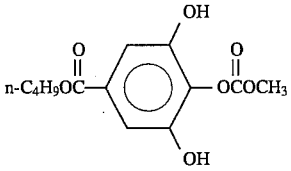
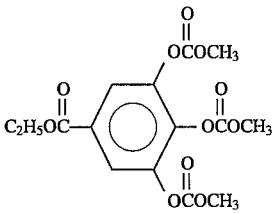
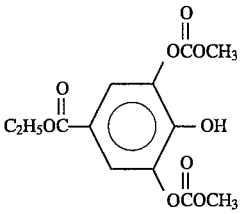
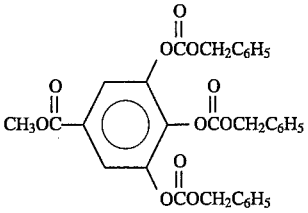
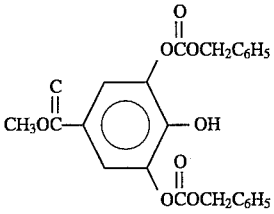
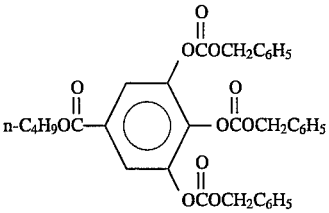
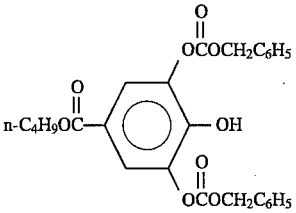
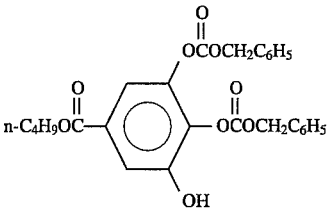
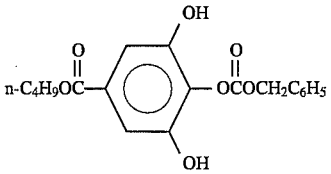
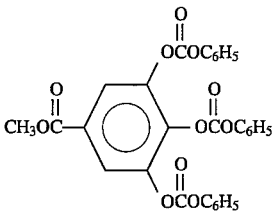
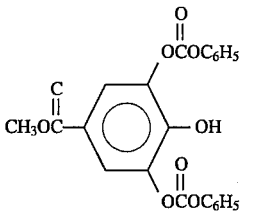
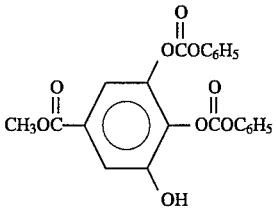

-continued
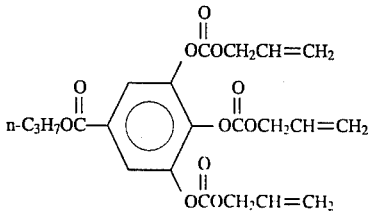
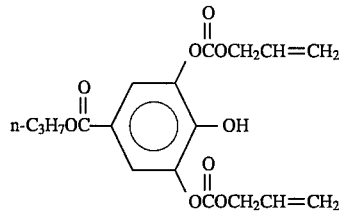
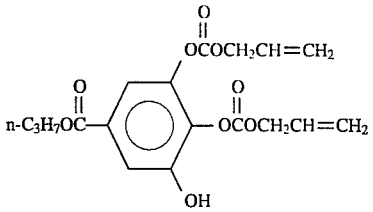
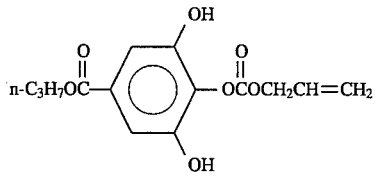
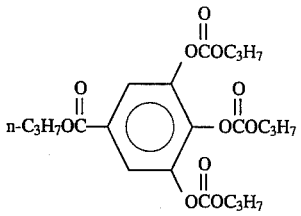
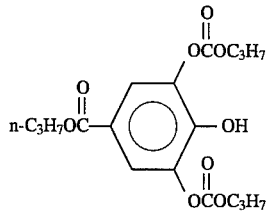
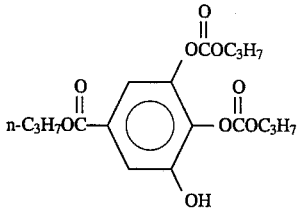
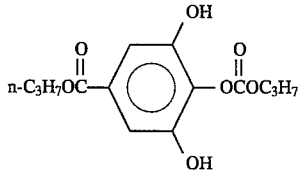
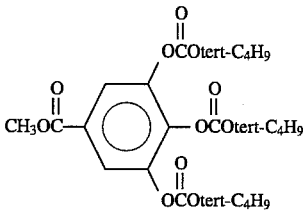
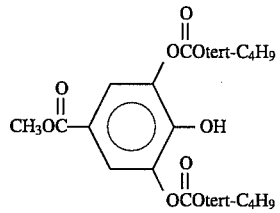
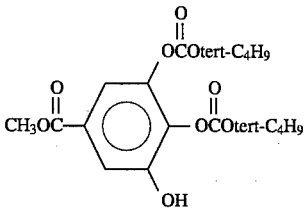
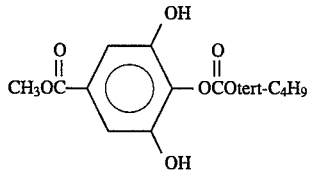
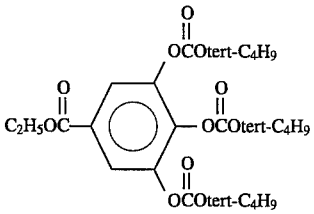
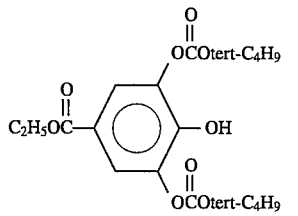

-continued
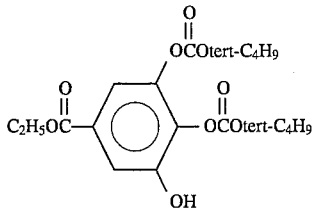
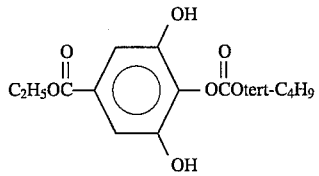
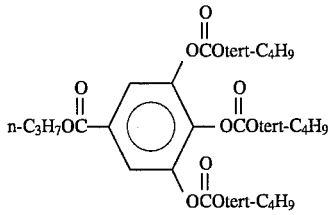
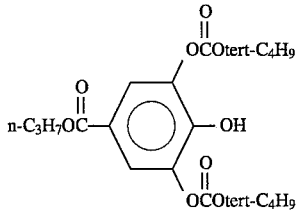
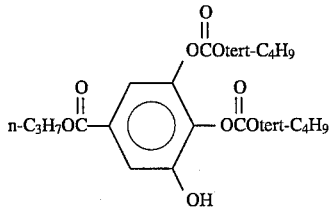
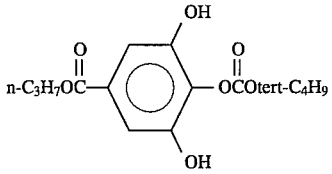
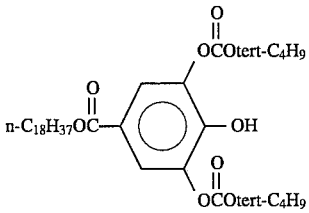
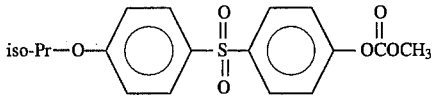
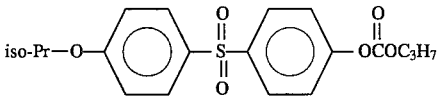
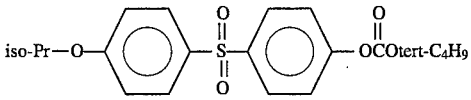
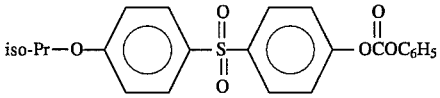
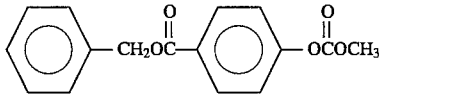
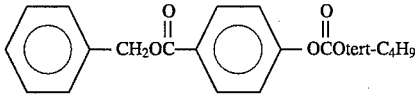
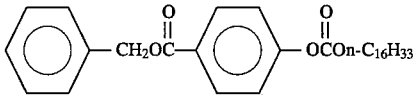
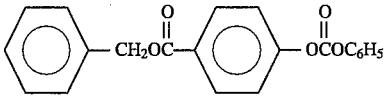
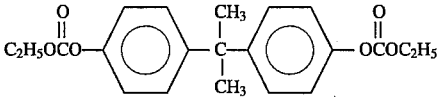
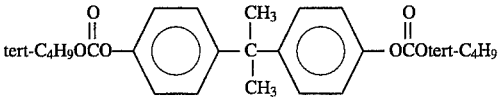
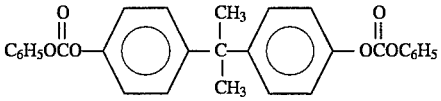
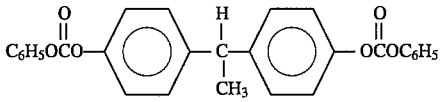
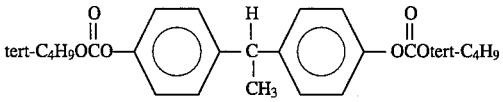
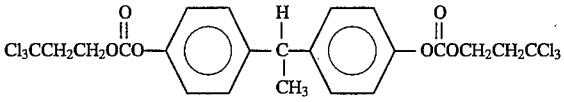

-continued
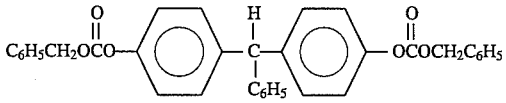
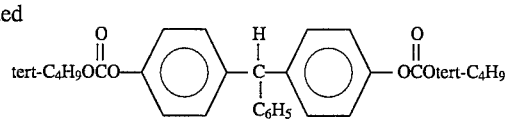
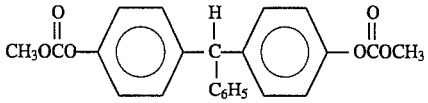
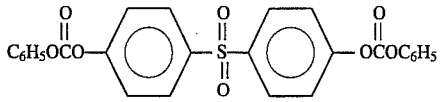
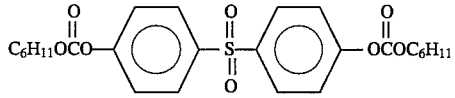
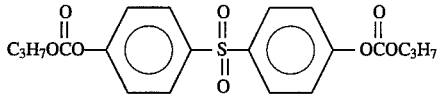
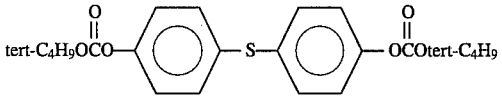
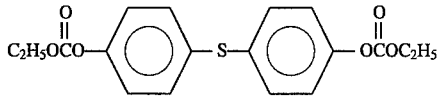
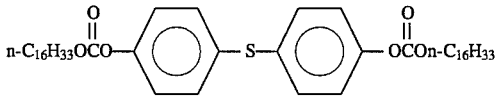
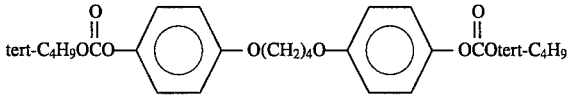
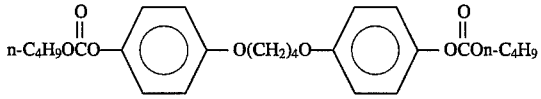
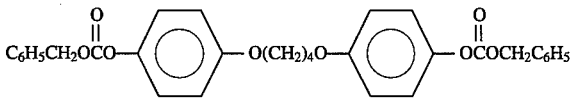
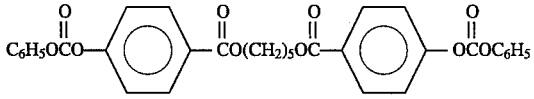
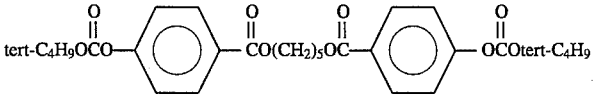
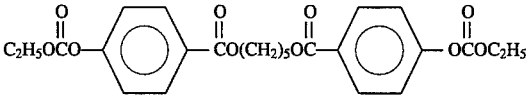
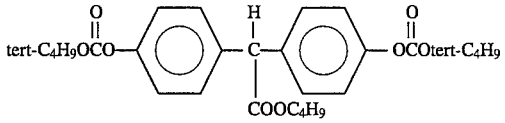
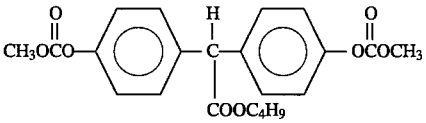
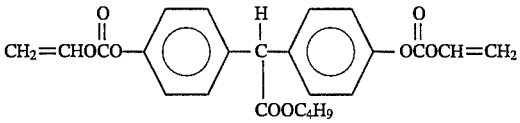
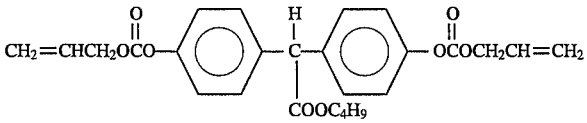
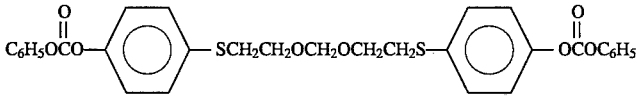

-continued

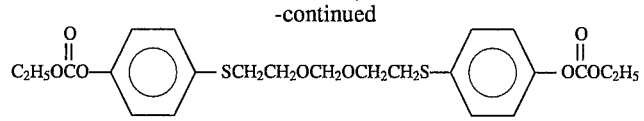

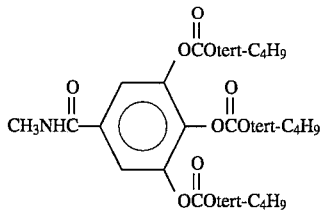

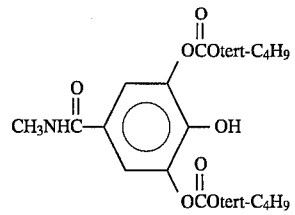

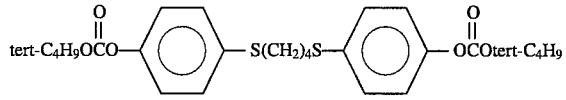

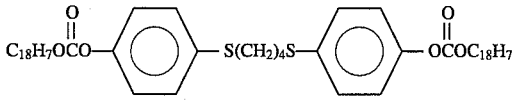

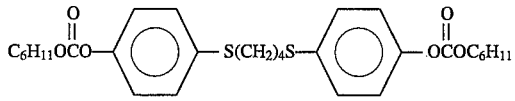

However, by protecting the hydroxyl group, it is possible to widely select organic metal salts, inorganic metal salts, and leuco dyes.

Organic acid used in the organic metal salts of the present invention include benzoic acid compounds such as o-benzoylbenzoic acid, o-alkyl substituted benzoylbenzoic acid. o-alkylbenzoic acid, m-alkylbenzoic acid, o-toluylbenzoic acid, m-toluylbenzoic acid, o-halogenated benzoic acid, and m-halogenated benzoic acid; and fatty acids such as acetic acid, propionic acid, stearic acid, behenic acid, and palmitic acid. Metal elements in the metal salts of organic acids include iron, zinc, silver, copper, tin, calcium, magnesium, aluminum, barium, manganese, nickel, vanadium, cobalt, titanium, tungsten, mercury, and the like. In the present invention, iron-salt is preferable.

The metal salts of inorganic acids include ferric chloride, ferric sulfate, ammonium vanadate, and the like.

The leuco dye used in the present invention can be any type of electron-donating colorless dyes known in the area of conventional pressure-sensitive or thermal recording paper. Typical types are shown below:

3,3-Bis (4'-dimethylaminophenyl)-6-dimethylaminophthalide (Crystal Violet Lactone)

3,3-Bis(4'-dimethylaminophenyl)phthalide (Malachite Green Lactone)

Tris[4-(dimethylamino)phenyl]methane (Leuco Crystal Violet)

3-Diethylamino-6-methylfluorane

3-Diethylamino-7-methylfluorane

3-Diethylamino-7-chlorofluorane

3-Diethylamino-6-methyl-7-chlorofluorane

3-Diethylamino-6-chloro-7-methylfluorane

3-Diethylamino-6-methyl-7-anilinofluorane

3-Diethylamino-6-methyl-7-p-methylanilinofluorane

3-Diethylamino-6-methyl-7-(o,p-dimethylanilino)fluorane

3-Diethylamino-6-methyl-7-(m-trifluoromethylanilino) fluorane

3-Diethylamino-7-(o-chloroanilino)fluorane

3-Diethylamino-7-(p-chloroanilino)fluorane

3-Diethylamino-6-methyl-7-(o-chloroanilino)fluorane

3-Diethylamino-6-methyl-7-(p-chloroanilino)fluorane

3-Diethylamino-6-methyl-7-(o-fluoranilino)fluorane

3-Diethylamino-6-methyl-7-n-octylanilinofluorane

3-Diethylamino-6-methyl-7-benzylanilinofluorane

3-Diethylamino-6-methyl-7-dibenzylanilinofluorane

3-Diethylamino-benzo[a]fluorane

3-Diethylamino-benzo[c]fluorane

3-Dibutylamino-6-methyl-7-anilinofluorane

3-Dibutylamino-6-methyl-7-p-methylanilinofluorane

3-Dibutylamino-6-methyl-7-(o-chloroanilino)fluorane

3-Dibutylamino-6-methyl-7-(p-chloroanilino)fluorane

3-Dibutylamino-6-ethoxyethyl-7-anilinofluorane

3-Dibutylamino-6-ethoxyethyl-7-anilinofluorane

3-Di-n-pentylamino-7-(o-chloroanilino)fluorane

3-Di-n-pentylamino-6-methyl-7-(o-chloroanilino)fluorane

3-Pyrrolidyl-6-methyl-7-anilinofluorane

3-Piperidyl-6-methyl-7-anilinofluorane 3-(N-ethyl-N-isoamylamino)-6-methyl-7-anilinofluorane 3-(N-ethyl-N-isoamylamino)-6-chloro-7-anilinofluorane 3-(N-ethyl-N-cyclohexyl)-6-methyl-7-anilinofluorane 2-(4-Oxahexyl)-3-diethylamino-6-methyl-7-anilinofluorane 3,6,6'-Tris(dimethylamino)spiro[fluorene-9,3'-phthalide]

3-(4-Diethylamino-2-ethoxyphenyl)-3-(1-ethyl-2-methylindol-3-yl)-4-azaphthalide 3-(4-Diethylamino-2-ethoxyphenyl)-3-(1-octyl-2-methylindol-3-yl)-4-azaphthalide 3-(4-Cyclohexylethylamino-2-methoxyphenyl)-3-(1-ethyl-2-methylindol-3-yl)-4-azaphthalide 3,3-Bis(1-ethyl-2-methylindol-3-yl)phthalide 3,6-Bis(diethylamino)fluorane-γ-(3'-nitro)anilinofluorane 3,6-Bis(diethylamino)fluorane-γ-(4'-nitro)anilinofluorane These dyes can be used alone or in combination. Furthermore, dyes which have heretofore been difficult to use due to liability to fogging can also be used.

The binder can be cellulose derivatives such as hydroxyethylcellulose, carboxymethylcellulose, methylcellulose, and ethylcellulose; starch and its derivatives; gelatine, caseine, polyvinylalcohol, sodium polyacrylate, donatured polyvinylalcohol such as fully saponified polyvinylalcohol, partially saponified polyvinylalcohol, carboxylated polyvinylalcohol, polyvinylbutyral; sodium polyacrylate, polyethyleneoxide, acrylamide-acrylic ester copolymer, styrene-maleic anhydride copolymer, polyacrylamide, sodium alginate, gelatin, casein, polystyrene, polyvinylacetate, polyurethane, polyacrylic acid, polyacrylic esters, styrene-butadiene copolymer, acrylonitrile-butadiene copolymer, vinylchloride-vinylacetate copolymer, styrene-butadiene-acrylic copolymer, and the like.

Among these, polyvinylalcohol type binders are more preferable in terms of dispersibility and the like. These binders are used by dissolving in water, alcohol, ketone, esters, hydrocarbons, or the like, or dispersing in water or other solvents, or dispersing in the form of a paste, and may be used as necessary.

The substrate can be paper, synthetic paper, non-woven fabrics, metallic foils, plastic films, plastic sheet, or the like, and composite sheets thereof may be used.

In the present invention, a sensitized, organic or inorganic fillers, waxes, an antisticking agent, an ultraviolet absorber, an antioxidant, a water-resistant agent, a dispersant, a defoamer, a fluorescent dye, and the like can be mixed in the recording layer as necessary.

As the sensitizer, any type of thermally fusible organic compounds known as sensitizers in the area of thermal recording can be used. Such sensitizers include:

Stearamide
Palmitamide
Ethylenebisamide
1,2-Diphenoxyethane
1,2-Di(3-methylphenoxy)ethane
p-Benzylbiphenyl
4-Biphenyl-p-tolylether
m-Terphenyl
Dibenzyl oxalate
Di(p-chlorobenzyl) oxalate
Di(p-methylbenzyl) oxalate
Benzyl terephthalate
Benzyl p-bezyloxybenzoate Prior art sensitizers in the area of thermal recording are lower in melting point than the leuco dyes and color developers; the sensitizer first melts by heat, and then the molten sensitizer dissolves with the leuco dye or the color developer to decrease the coloring start temperature. On the other hand, in the present invention, the coloring start temperature depends mainly on the decomposition temperature of the blocked color developer, the sensitizer melts to mix the color developer with the coloring substance homogeneously.

The organic or inorganic fillers include silica, kaolin, calcined kaolin, diatomaceous earth, talc, calcium carbonate, magnesium carbonate, titanium oxide, zinc oxide, aluminum hydroxide, urea-formaldehyde resin, styrene-methacrylic acid copolymer, styren-butadiene copolymer, polystyrene resin, and the like.

The types and amounts of the blocked color developer, the metal salt of organic acid, the inorganic metal salt or leuco dye, the binder, and other ingredients are determined according to the properties required and recording characteristics and not specifically limited but, normally, 1 to 10 parts of the blocked color developer, 0.5 to 5 parts of the metal salt of organic acid, the inorganic metal salt or leuco dye, and 0.5 to 10 in the total solids of the binder are used, and 2 to 15 parts of the filler is preferably used.

The recording sheet of the present invention can be provided on the recording layer with an overcoat layer comprising a polymeric substance to enhance the storage stability, or under the recording layer with an undercoat layer comprising a filler-containing polymeric substance to enhance the coloring sensitivity.

Since the recording sheet of the present invention is very high in the background color stability, it is possible to heat laminate with a plastic film to provide a transparent and strong protective film. For example, heat-resistant cards can be easily produced using a commercial laminate machine. Further, the recording surface can be toner recorded.

To obtain an optical recording sheet, a dispersion comprising a sensitizer containing a light absorbent dispersed with a binder is mixed with the above dispersions to obtain an opaque undeveloped coating color for optical recording sheet. The coating color is coated on the substrate and dried to obtain an optical recording sheet.

The light absorbent used in the optical recording sheet of the present invention can be a substance which absorbs wavelengths of various light sources, and various types of dyes, pigments, near-infrared absorbents, and the like can be used.

Specifically, when a stroboflash lamp or the like is used as a recording light source (continuous wavelength), light absorbents are heat reaction products of thiourea derivative/cooper compounds described in Japanese OPI 2-206583 and Japanese Patent Application 5-30954 (Japanese Patent Publication Laid-open 5-199664), graphite, copper sulfide, molubdenum trisulfide, titanium black, carbon black, and like.

When a semiconductor laser and the like is used as a recording light source (single wavelength), the light absorbent can be immonium or diimmonium compounds such as IRGOO2 (Nippon Kayaku) or IRGO22 (Nippon Kayaku); dithiolatenickel complexes such as bisdithiobenzilnickel complex, toluenedithiolnickel complex, or 4-tert-butyl-1,2-benzenedithiolnickel complex; cyanine type dyes such as Indocyanine Green (Dia-ichi Seiyaku), NK-2014 (Nippon Kanko Shikiso Kenkyusho), NK-2612 (Nippon Kanko Shikiso Kenkyusho), 1,1,5,5-tetrakis(p-dimethylkaminiphenyl)-3-methoxy-1,4-pentadienetoluene, 1,1,5,5-tetrakis(p-diethylaminophenyl)-3-methoxy-1,4-pentadienotolune; squalylium type dyes such a NK-2772 (Nippon Kanko Shikiso Kenkyusho); naphtoquinone type dyes, phthalocyanine type dyes, naphthoquinone type dyes, or anthraquinone type dyes. These light absorbents can also be used in combination.

Recording to the optical recording sheet is preferably achieved by a laser, rather than by a thermal head, using a semiconductor laser of several tens of mW.

The resulting recording sheet is also useful as a recording material which is superior in heat resistance and solvent resistance, or as a high-temperature thermolabel utilizing a specific temperature at which the blocked group dissociates.

In the thus obtained recording sheet, the blocked group of the blocked color developer is dissociated by way of light or heat to reveal a color developing function, and immediately reacts with the metal salt or leuco dye to develop a color. Therefore, the recording sheet of the present invention does not develop a color unless the blocked group of the blocked color developer dissociates, and does not cause unnecessary coloring by heat or solvents. Further, the carbonate type blocked color developer, when the blocked group dissociates by heating is considered to decompose to a color developing compound, carbon dioxide, and a compound derived from O-substituent of the O-substituted oxycarbonyl group, and is thus relatively high in safety.

Furthermore, the resulting recording sheet, when thermally recorded by a thermal head, tends to be difficult to give a sharp image in high-speed recording depending on the energy applied, due to difficulty in dissociation of the blocked group. On the other hand, the optical recording sheet containing a light absorbent can be recorded in a high density by irradiation of laser light because laser irradiation can be higher in energy density than a thermal head.

DESCRIPTION OF PREFERRED EMBODIMENTS

Production of the blocked color developer

Compounds (8) to (23) were synthesized by the following method:

(8)

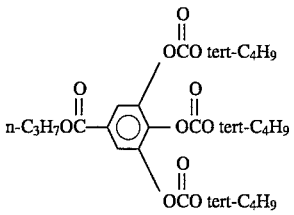

(9)

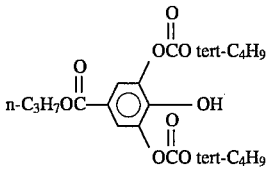

(10)

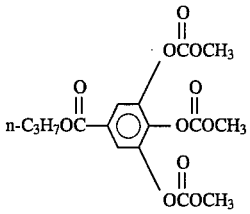

(11)

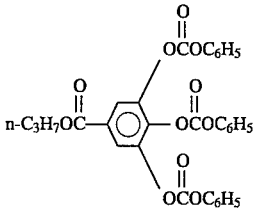

(12)

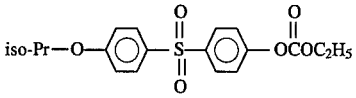

(13)

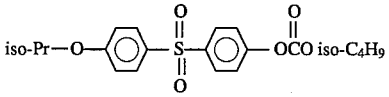

(14)

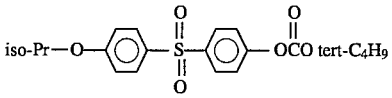

-continued (15)

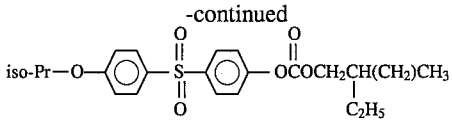

(16)

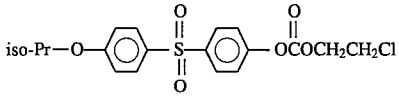

(17)

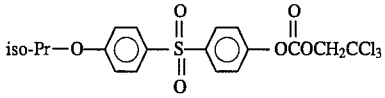

(18)

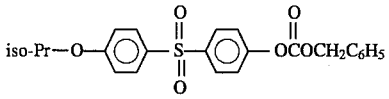

(19)

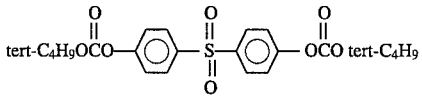

(20)

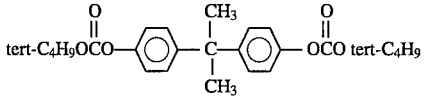

(21)

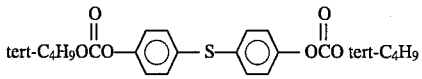

(22)

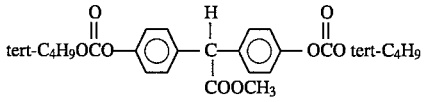

(23)

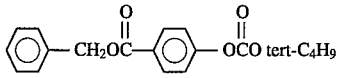

Melting point was measured by thermoanalysis (SSC5200 System (Seiko Denshi)). Melting points were not noted in Synthesis Examples 1, 3, and 12.

Synthesis Example 1

(synthesis of Compound (8))

n-Propyl gallate in an amount of 5.3 g (25 mM) was dissolved in ethyl acetate (25 ml), and then mixed with 23 ml (100 mM) of di-tert-butyl dicarbonate and pyridine (2 ml). The solution was reacted at 50° C. for 2.5 hours in a nitrogen atmosphere. The reaction solution was diluted with ethyl acetate, washed with 6% sodium hydroxide solution, 1N hydrochloric acid, and brine dried with anhydrous sodium sulfate, and the solvent was distilled out. The resulting oily substance was crystallized from n-hexane. The product was identified by means of $^1$H-NMR to be n-propyl gallate tri-tert-butyl carbonate. (Yield: 67.2%)

Melting point: 60° C. $^1$H-NMR: 0.94 (3H, t, J=7.5), 1.47 (27H, s), 1.67–1.74 (2H, m), 4.20 (2H, t, J=6.6), 7.77 (2H, s).

Synthesis Example 2

(Synthesis of compound (9))

n-Propyl gallate in an amount of 1.06 g (5 mM) was dissolved in ethyl acetate (20 ml), and then mixed with 5.7 ml (25 mM) of di-tert-butyl dicarbonate and pyridine (2 ml). The solution was reacted at room temperature for 2.5 hours in a nitrogen atmosphere. The reaction solution was treated using the same procedure as in Synthesis Example 1. The resulting oily substance was purified by a silica gel column (developing solution: ethyl acetate/n-hexane (v/v=1:2)). The product was identified by means of $^1$H-NMR to be n-propyl gallate di-tert-butylcarbonate. (Yield: 50.4%)

$^1$H-NMR: 1.01 (3H, t, J=7.0), 1.56 (18H, s), 1.74–1.81 (2H, m) 4.24 (2H, t, J=7.0), 7.79 (2H, s).

Synthesis Example 3

(Synthesis of compound (10))

n-Propyl gallate in an amount of 1.06 g (5 mM) was dissolved in ethyl acetate (20 ml), and then mixed with 1.9 ml (25 mM) of methyl chloroformate and pyridine (2 ml). The solution was reacted at 50° C. for 3 hours in a nitrogen atmosphere. The reaction solution was treated using the same procedure as in Synthesis Example 2 to obtain n-propyl gallate trimethylcarbonate. (Yield: 60.2%)

$^1$H-NMR: 1.01 (3H, t, J=7.4), 1.78 (2H, m), 3.92 (3H, s), 3.93 (6H, s), 4.28 (2H, t, J=7.4), 7.91 (2H, s).

Synthesis Example 4

Synthesis of compound (11))

n-Propyl gallate in an amount of 1.06 g (5 mM) was dissolved in ethyl acetate (20 ml), and then mixed with 2.5 ml (20 mM) of phenyl chloroformate and pyridine (1 ml). The solution was reacted at 50° C. for 3 hours in a nitrogen atmosphere. The reaction solution was treated using the same procedure as in Synthesis Example 2 to obtain n-propyl gallate triphenylcarbonate. (Yield: 58.6%)

Melting point: 99° C. $^1$H-NMR: 1.02 (3H, t, J=7.0), 1.80 (2H, dd, J=14.0, 7.1), 4.30 (2H, t, J=6.7). 7.23–7.44 (15H, m), 8.08 (2H, s).

Synthesis Example 5

(Synthesis of compound (12)) 4-Hydroxy-4'-isopropyloxydiphenylsulfone in an amount of 1.17 g (4 mM) was dissolved in ethyl acetate (7 ml), and pyridine (0.65 ml). The solution was reacted at 50° C. for 30 minutes in a nitrogen atmosphere. The reaction solution was treated using the same procedure as in Synthesis Example 1 to obtain 4ethyloxycarbonyloxy-4'-isopropyloxydiphenysulfone. (Yield: 93.7%)

Melting point: 88° C. $^1$H-NMR: 1.33 (3H, s), 1.35 (3H, s), 1.39 (3H, t, J=6.5), 4.33 (2H, dd, J=14.0, 6.5), 4.61 (1H, ddd, J=12.0, 6.1 6.0), 6.93 ((2H, d, J=10.0), 7.31 (2H, d, J=9.5), 7.84 (2H, d, J=10.0), 7.95 (2H, d, J=9.5).

Synthesis Example 6

Synthesis of compound (13)) 4-Hydroxy-4'-isopropyloxydiphenylsulfone in an amount of 1.17 g (4 mM) was dissolved in ethyl acetate (7 ml), and then mixed with 0.79 ml (6 mM) of iso-butyl chloroformate and pyridine (0.65 ml). The solution was reacted at 50° C. for 1 hour in a nitrogen atmosphere. The reaction solution was treated using the same procedure as in Synthesis Example 1 to obtain 4-iso-butoxycarbonyloxy-4'-isopropyloxydiphenylsulfone. (Yield: 75.8%)

Melting point: 81° C. $^1$H-NMR: 0.98(3H, s), 1.00 (3H. s), 1.33 (3H, s), 2.00–2.11 (1H, m), 4.04 (2H, d, J=6.5), 4.57–4.65 (1H, m), 6.93 (2H, d. J=9.0), 7.31 (2H, d, J=9.0), 7.84 (2H, d. J=9.0 ), 7.95 (2H, d, J=9.0).

Synthesis Example 7

(Synthesis of compound (14)

4-Hydroxy-4'-isopropyloxydiphenylsulfone in an amount of 1.75 g (6 mM) was dissolved in ethyl acetate (10 ml), and then mixed with 1.6 ml (7.2 mM) of di-tert-butyldicarbonate and pyridine (2 ml). The solution was reacted at 50° C. for 3 hours in a nitrogen atmosphere. The reaction solution was treated using the same procedure as in Synthesis Example 1. The product was identified by means of $^1$H-NMR to be 4-tert-butoxycarbonyloxy-4'-isopropyloxydiphenylsulfone.

Melting point: 105° C. $^1$H-NMR: 1.33 (3H, s), 1.35 (3H. s), 1.55 (9H, s), 4.60 (1H, m), 6.92 (2H, d, J=8.5), 7.29 (2H, d, J=8.5), 7.83 (2H, d, J=8.5), 7.94 (2H, d, J=8.5).

Synthesis Example 8

(Synthesis of compound (15))

4-Hydroxy-4'-isopropyloxydiphenylsulfone in an amount of 1.17 g (4 mM) was dissolved in ethyl acetate (7 ml), and then mixed with 0.97 ml (5 mM) of 2-ethylhexyl chloroformate and pyridine (0.5 ml). The solution was reacted at 50° C. for 3 hours in a nitrogen atmosphere. The reaction solution was treated using the same procedure as in Synthesis Example 1 to obtain 4-(2-ethylhexyloxy)carbonyloxy-4'-isopropyloxydiphenylsulfone as a colorless oily substance. (Yield: 50%)

$^1$H-NMR: 0.90(3H, t, J=7.0), 0.92 (3H, t, J=7.5), 1.30–1.40 (15H, m), 4.18 (2H, dd, J=6.0, 1.5), 4.61 (1H, ddd, J=11.5, 6.0, 6.0), 6.93 (2H, d, J=9.0), 7.31 (2H, d, J=9.0), 7.84 (2H, d, J=9.0), 7.94 (2H, d, J=9.0).

Synthesis Example 9

(Synthesis of compound (16))

4-Hydroxy-4'-isopropyloxydiphenylsulfone in an amount of 1.17 g (4 mM) was dissolved in ethyl acetate (7 ml), and then mixed with 0.62 ml (6 mM) of 2-chloroethyl chloroformate and pyridine (0.65 ml). The solution was reacted at 50° C. for 1 hour in a nitrogen atmosphere. The reaction solution was treated using the same procedure as in Synthesis Example 1 to obtain 4-(2-chloroethoxy) carbonyloxy-4'-isopropyloxydiphenylsulfone. (Yield: 90.3%)

Melting point: 111° C. $^1$H-NMR: 1.33 (3H, s), 1.35 (3H. s), 3.78 (2H, t, J=6.0), 4.51 (2H, t, J=6.0), 4.61 (1H, dt, J=12.0, 6.0), 6.93 (2H, d, J=9.0), 7.32 (2H, d, J=9.0), 7.84 (2H, d, J=9.0), 7.95 (2H, d, J=9.0).

Synthesis Example 10

(Synthesis of compound (17))

4-Hydroxy-4'-isopropyloxydiphenylsulfone in an amount of 1.17 g (4 mM) was dissolved in ethyl acetate (7 ml), and then mixed with 0.80 ml (6 mM) of 2,2,2-trichloroethyl chloroformate and pyridine (0.65 ml). The solution was reacted at 50° C. for 1 hour in a nitrogen atmosphere. The reaction solution was treated using the same procedure as in Synthesis Example 1 to obtain 4-(2,2,2-trichloroethoxy)carbonyloxy-4'-isopropyloxydiphenylsulfone. (Yield: 28.7%)

Melting point: 103° C. $^1$H-NMR: 1.33 (3H, s), 1.36 (3H. s), 4.57–4.65 (1H, m), 6.94 (2H, d, J=9.0), 7.37 (2H, d, J=9.0), 7.85 (2H, d, J=9.0), 7.98 (2H, d, J=9.0).

Synthesis Example 11

(Synthesis of compound (18))

4-Hydroxy-4'-isopropyloxydiphenylsulfone in an amount of 1.17 g (4 mM) was dissolved in ethyl acetate (5 ml), and then mixed with 3.6 ml of toluene solution (30–35%) of benzyl chloroformate and pyridine (0.65 ml). The solution was reacted at 50° C. for 3 hours in a nitrogen atmosphere. The reaction solution was treated using the same procedure as in Synthesis Example 1 to obtain 4-benzyloxycarbonyloxy-4'-isopropyloxydiphenylsulfone. (Yield: 74.3%)

Melting point: 119° C. $^1$H-NMR: 1.33 (3H, s), 1.35 (3H. s), 4.61 (1H, ddd, J=12.0, 6.0, 6.0), 5.26 (2H, s), 6.86–6.92 (1H, m), 6.93 (2H, d, J=10.0), 7.31 (2H, d, J=9.5), 7.36–7.44 (4H, m), 7.83 (2H, d, J=9.5), 7.98 (2H, J=10.0).

Synthesis Example 12

(Synthesis of compound (19))

Bis(4-hydroxyphenyl)sulfone in an amount of 1.0 g (4 mM) was dissolved in ethyl acetate (10 ml), and then mixed with 2.7 ml (12 mM) of di-tert-butyldicarbonate and pyridine (1 ml). The solution was reacted at 50° C. for 3 hours in a nitrogen atmosphere. The reaction solution was treated using the same procedure as in Synthesis Example 1. The product was identified by means of $^1$H-NMR to be di-tert-butylcarbonate of bis(4-hydroxyphenyl)sulfone. (Yield: 73.6%)

$^1$H-NMR: 1.55 (18H,s), 7.32 (4H, d, J=8.0), 7.95 (4H, d, J=8.0).

Synthesis Example 13

(Synthesis of compound (20))

Bisphenol A in an amount of 2.28 g (10 mM) was dissolved in ethyl acetate (10 ml), and then mixed with 6.9 ml (30 mM) of di-tert-butyldicarbonate and pyridine (1 ml). The solution was reacted at 50° C. for 3 hours in a nitrogen atmosphere. The reaction solution was treated using the same procedure as in Synthesis Example 1. The product was identified by means of $^1$H-NMR to be bisphenol A with its hydroxyl group blocked by di-tert-butoxycarbonyl group. (Yield: 60.9%)

Melting point: 103° C. 1 H-NMR: 1.55 (18H,s), 1.65 (6H, s), 7.05 (4H, d, J=8.5), 7.21 (4H, dt, J=8.5).

Synthesis Example 14

(Synthesis of compound (21))

4,4'-Thiodiphenol in an amount of 0.87 g (4 mM) was dissolved in ethyl acetate (10 ml), and then mixed with 2.7 ml (12 mM) of di-tert-butyldicarbonate and pyridine (1 ml). The solution was reacted at 50° C. for 3 hours in a nitrogen atmosphere. The reaction solution was treated using the same procedure as in Synthesis Example 1 to obtain di-tert-butylcarbonate of 4,4'-thiodiphenol. (Yield: 66.6%)

Melting point: 131° C. $^1$H-NMR: 1.55 (18H, s), 7.11 (4H, d, J=8.6), 7.33 (4H, dt, J=8.6).

Synthesis Example 15

(Synthesis of compound (22))

Methyl bis(4-hydroxyphenyl)acetate in an amount of 1.0 g (4 mM) was dissolved in ethyl acetate (10 ml), and then mixed with 2.7 ml (12 mM) of di-tert-butyldicarbonate and pyridine (1 ml). The solution was reacted at 50° C. for 2.5 hours in a nitrogen atmosphere. The reaction solution was treated using the same procedure as in Synthesis Example 1 to obtain di-tert-butylcarbonate of methyl bis(4-hydroxyphenyl)acetate. (Yield: 79.9%)

Melting point: 140° C. $^1$H-NMR: 1.55 (18H, s), 3.73 (3H, s), 5.00 (1H, s), 7.12 (4H, d, J=8.0), 7.30 (4H, dt, J=8.6).

Synthesis Example 16

(Synthesis of compound (23))

Benzyl p-hydroxybenzoate in an amount of 0.9 g (4 mM) was dissolved in ethyl acetate (10 ml), and then mixed with 2.7 ml (12 mM) of di-tert-butyldicarbonate and pyridine (1 ml). The solution was reacted at 50° C. for 2.5 hours in a nitrogen atmosphere. The reaction solution was treated using the same procedure as in Synthesis Example 1 to obtain benzyl p-(tert-butoxycarbonyloxy)benzoate. (Yield: 39.6%)

Melting point: 81° C. $^1$H-NMR: 1.55 (9H, s), 5.36 (2H, s), 7.25 (2H, d, J=9.0), 7.31–7.47 (5H, m), 8.10 (2H, d, J=9.0).

Production of recording sheet

EXAMPLE 1

A metal salt dispersion (solution A) of the composition shown below and a dispersion (solution B) of the blocked color developer of Synthesis Example 1 were individually wet pulverized for 1 hour by a sand grinder.

| | |
|---|---|
| Solution A: (metal salt dispersion) | |
| Iron behenate | 4.0 parts |
| 10% Aqueous polyvinylalcohol solution | 10.0 |
| Water | 6.0 |
| Solution B: (blocked color developer dispersion) | |
| Blocked color developer of Synthesis Example 1 | 4.0 parts |
| Zinc stearate | 1.5 |
| 10% Aqueous polyvinylalcohol solution | 13.75 |
| Water | 8.25 |

Then, 20 parts of the solution A, 36.5 parts of the solution B, and 12 parts of a 50% aqueous dispersion of silica were mixed to obtain a coating color. The coating color was coated on fine paper with a substance of 60 g/m$^2$ using a Meyer bar, and dried to obtain an optical recording sheet with a coating coverage of 6 g/m$^2$.

The recording sheet was printed by a label printer of the TEC Electronic Fee-Charging Scale HP-9303 (Tokyo Denki) to obtain a print.

EXAMPLE 2

A dispersion (solution C) of light absorbent sensitizer of the composition shown below was wet pulverized for 1 hour by a sand grinder. (optical density—1.28(measured by RD-914)) Solution C: (light absorbent dispersion)

p-Benzylbiphenyl (PBB) in an amount of 49 parts was mixed with 1 part of toluenedithiolnickel complex, heated to 100°–150° C. to melt, and pulverized by a sand grinder to obtain a light absorbent sensitizer.

| | |
|---|---|
| Light absorbent sensitizer | 4.0 parts |
| 10% Aqueous polyvinylalcohol solution | 10.0 |
| Water | 6.0 |

Then, 10 parts of the solution A of Example 1, 42 parts of the solution B of Example 1, 20 parts of the solution C, 25 parts of 25% aqueous dispersion of silica, and 10 parts of a 10% aqueous polyvinylalcohol solution were mixed to obtain a coating color. The coating color was coated on fine paper with a substance of 60 g/m$^2$ using a Meyer bar, and dried to obtain an optical recording sheet with a coating coverage of 6 g/m$^2$.

The recording sheet was irradiated with laser light by a laser plotter described in Japanese OPI 03-239598 to obtain a clear print.

EXAMPLE 3

The same procedure as in Example 2 was used, except that a dispersion (solution D) of leuco dye of the following composition was used in place of the solution A of Example 1, to obtain an optical recording sheet.

| Solution D: (leuco dye dispersion) | |
|---|---|
| ODB | 2.0 parts |
| 10% Aqueous polyvinylalcohol solution | 3.4 |
| Water | 1.9 |

*ODB=3-diethylamino-6-methyl-7-anilinofluorane

The recording sheet was irradiated with laser light as in Example 2 to obtain a clear print.

EXAMPLE 4

The same procedure as in Example 2 was used, except that iron o-benzoylbenzoate was used in place of the iron behenate in the metal salt dispersion (solution A) of Example 1, to obtain an optical recording sheet.

The recording sheet was irradiated with laser light as in Example 2 to obtain a clear print.

EXAMPLE 5

The same procedure as in Example 2 was used, except that dithiobenzilnickel complex was used in place of the toluenedithiolnickel complex in the light absorbent sensitizer dispersion (solution C) of Example 2, to obtain an optical recording sheet.

The recording sheet was irradiated with laser light as in Example 2 to obtain a clear print.

EXAMPLE 6

The same procedure as in Example 2 was used, except that the blocked color developer of Synthesis Example 2 was used in place of the blocked color developer of Synthesis Example 1 in the blocked color developer dispersion (solution B) of Example 1, to obtain an optical recording sheet.

The recording sheet was irradiated with laser light as in Example 2 to obtain a clear print.

EXAMPLE 7

The same procedure as in Example 2 was used, except that the blocked color developer of Synthesis Example 3 was used in place of the blocked color developer of Synthesis Example 1 in the blocked color developer dispersion (solution B) of Example 1, to obtain an optical recording sheet.

The recording sheet was irradiated with laser light as in Example 2 to obtain a clear print.

EXAMPLE 8

The same procedure as in Example 2 was used, except that the blocked color developer of Synthesis Example 4 was used in place of the blocked color developer of Synthesis Example 1 in the blocked color developer dispersion (solution B) of Example 1, to obtain an optical recording sheet.

The recording sheet was irradiated with laser light as in Example 2 to obtain a clear print.

EXAMPLE 9

A dispersion (solution E) of blocked color developer of the composition shown below was pulverized for 1 hour by a sand grinder.

| Solution E: (blocked color developer dispersion) | |
|---|---|
| Blocked color developer of Synthesis Example 5 | 6.0 parts |
| 10% Aqueous polyvinylalcohol solution | 15.0 |
| Water | 9.0 |

Then, 10 parts of the solution D of Example 3, 30 parts of the solution E, 20 parts of the solution C of Example 2, 25 parts of 25% aqueous dispersion of silica, and 10 parts of a 10% aqueous polyvinylalcohol solution were mixed to obtain a coating color. The coating color was coated on fine paper with a substance of 60 g/m$^2$ using a Meyer bar, and dried to obtain an optical recording sheet with a coating coverage of 6 g/m$^2$.

The recording sheet was irradiated with laser light as in Example 2 to obtain a clear print.

EXAMPLE 10

The same procedure as in Example 9 was used, except that the blocked color developer of Synthesis Example 6 was used in place of the blocked color developer of Synthesis Example 5 in the blocked color developer dispersion (solution B) of Example 1, to obtain an optical recording sheet.

The recording sheet was irradiated with laser light as in Example 2 to obtain a clear print.

EXAMPLE 11

A dispersion (solution F) of blocked color developer of the composition shown below was pulverized for 1 hour by a sand grinder.

| Solution F: (blocked color developer dispersion) | |
|---|---|
| Blocked color developer of Synthesis Example 7 | 6.0 parts |
| 10% Aqueous polyvinylalcohol solution | 15.0 |
| Water | 9.0 |

Then, 15 parts of the solution D of Example 3, 35 parts of the solution F, and 12 parts of 50% aqueous dispersion of silica were mixed to obtain a coating color. The coating color was coated on fine paper with a substance of 60 g/m$^2$ using a Meyer bar, and dried to obtain an optical recording sheet with a coating coverage of 6 g/m$^2$.

The recording sheet was possible to be printed by the same method as in Example 1. (optical density=1.25)

EXAMPLE 12

The same procedure as in Example 9 was used, except that the blocked color developer dispersion (solution F) of Synthesis Example 11 was used in place of the blocked color developer dispersion (solution E) of Synthesis Example 9, to obtain an optical recording sheet.

The recording sheet was irradiated with laser light as in Example 2 to obtain a clear print.

EXAMPLE 13

The same procedure as in Example 12 was used, except that NK-2612 (Nippon Kanko Shikiso Kenkyusho) was used as a light absorbent in place of toluenedithiolnickel complex in the light absorbent sensitizer dispersion (solution C) of Example 2, to obtain an optical recording sheet.

The recording sheet was irradiated with laser light as in Example 2 to obtain a clear print.

EXAMPLE 14

The same procedure as in Example 12 was used, except that 1,1,5,5-tetrakis-(p-dimethylaminophenyl)-3-methoxy-1,4-pentadiene was used as a light absorbent in place of toluenedithiolnickel complex in the light absorbent sensitizer dispersion (solution C) of Example 2, to obtain an optical recording sheet.

The recording sheet was irradiated with laser light as in Example 2 to obtain a clear print.

EXAMPLE 15

The same procedure as in Example 12 was used, except that the blocked color developer of Synthesis Example 9 was used in place of the blocked color developer of Synthesis Example 7 in the blocked color developer dispersion (solution F) of Example 11, to obtain an optical recording sheet.

The recording sheet was irradiated with laser light as in Example 2 to obtain a clear print.

EXAMPLE 16

The same procedure as in Example 12 was used, except that the blocked color developer of Synthesis Example 10 was used in place of the blocked color developer of Synthesis Example 7 in the blocked color developer dispersion (solution F) of Example 11, to obtain an optical recording sheet.

The recording sheet was irradiated with laser light as in Example 2 to obtain a clear print.

EXAMPLE 17

The same procedure as in Example 12 was used, except that the blocked color developer of Synthesis Example 11 was used in place of the blocked color developer of Synthesis Example 7 in the blocked color developer dispersion (solution F) of Example 11, to obtain an optical recording sheet.

The recording sheet was irradiated with laser light as in Example 2 to obtain a clear print.

EXAMPLE 18

The same procedure as in Example 11 was used, except that the blocked color developer of Synthesis Example 12 was used in place of the blocked color developer of Synthesis Example 7 in the blocked color developer dispersion (solution F) of Example 11, to obtain an optical recording sheet.

The recording sheet was irradiated with laser light as in Example 2 to obtain a clear print.

EXAMPLE 19

The same procedure as in Example 11 was used, except that CVL was used in place of ODB in the leuco dye dispersion (solution D) of Synthesis Example 3, to obtain an optical recording sheet.

*CVL=Crystal Violet Lactone

The recording sheet was possible to be printed by the same method as in Example 1. (optical density=0.88)

EXAMPLE 20

A dispersion (solution G) of blocked color developer and a dispersion (solution H) of following composition were pulverized for 1 hour by a sand grinder.

| Solution G: (blocked color developer dispersion) | |
|---|---|
| Blocked color developer of Synthesis Example 12 | 6.0 parts |
| 10% Aqueous polyvinylalcohol solution | 15.0 |
| Water | 9.0 |

Solution H: (light absorbent sensitizer dispersion)

p-Benzylbiphenyl (PBB) in an amount of 48.4 parts was mixed with 1 part of toluenedithiolnickel complex and 0.6 part of NK-2612 (Nippon Kanko Shikiso Kenkyusho), heated to 100°–150° C. to melt, and treated by a sand grinder to obtain a light absorbent sensitizer.

| | |
|---|---|
| Light absorbent sensitizer | 4.0 parts |
| 10% Aqueous polyvinylalcohol solution | 10.0 |
| Water | 6.0 |

Then, 7.3 parts of the solution D of Example 3, 30 parts solution G, 20 parts of the solution H, 25 parts of 25% aqueous dispersion of silica, and 8 parts of 10% polyvinylalcohol were mixed to obtain a coating color. The coating color was coated on fine paper with a substance of 60 g/m$^2$ using a Meyer bar, and dried to obtain an optical recording sheet with a coating coverage of 6 g/m$^2$.

The recording sheet was irradiated with laser light as in Example 2 to obtain a clear print.

EXAMPLE 21

The same procedure as in Example 12 was used, except that the blocked color developer of Synthesis Example 13 was used in place of the blocked color developer of Synthesis Example 1 in the blocked color developer dispersion (solution B) of Example 1, to obtain an optical recording sheet.

The recording sheet was irradiated with laser light as in Example 2 to obtain a clear print.

EXAMPLE 22

The same procedure as in Example 12 was used, except that the blocked color developer of Synthesis Example 14 was used in place of the blocked color developer of Synthesis Example 7 in the blocked color developer dispersion (solution F) of Example 11, to obtain an optical recording sheet.

The recording sheet was irradiated with laser light as in Example 2to obtain a clear print.

EXAMPLE 23

The same procedure as in Example 5 was used, except that the blocked color developer of Synthesis Example 15 was used in place of the blocked color developer of Synthesis Example 1 in the blocked color developer dispersion (solution B) of Example 1, to obtain an optical recording sheet.

The recording sheet was irradiated with laser light as in Example 2 to obtain a clear print.

EXAMPLE 24

The same procedure as in Example 12 was used, except that the blocked color developer of Synthesis Example 16 was used in place of the blocked color developer of Synthesis Example 7 in the blocked color developer dispersion (solution F) of Example 11, to obtain an optical recording sheet.

The recording sheet was irradiated with laser light as in Example 2 to obtain a clear print.

EXAMPLE 25

The same procedure as in Example 2 was used, except that ammonium vanadate was used in place of the iron behenate in the metal salt dispersion (solution A) of Example 1, to obtain a clear print.

The recording sheet was irradiated with laser light as in Example 2 to obtain a clear print.

Comparative Example

The same procedure as in Example 1 was used, except that a color developer with phenolic hydroxyl group having a color developing function unblocked, that is, n-propyl gallate, was used in place of the blocked color developer of Synthesis Example 1 in the blocked color developer dispersion (solution B) of Example 1, to obtain an ordinary thermal recording sheet.

The ordinary thermal recording sheet underwent background coloring in a heat resistance test (80° C., 3 hours). However, no background coloring was noted in the recording sheet of the Example.

Further, in writing tests by an ink, background coloring was noted in the ordinary thermal recording sheet, whereas no change in background color was noted in the recording sheet of the Example.

Furthermore, when heat lamination was carried out using a pouch film by means of a Simple Lamination Apparatus (KS Pouch H-140: Meiko Shokai), the recording sheet of the Comparative Example underwent background coloring, whereas no change in background color was noted in the recording sheet according to the present invention.

As described above, with the blocked color developers of the present invention, since no coloring occurs as much as the blocked group of the blocked color developer does not dissociate, a recording sheet which is superior in solvent resistance and heat resistance to conventional recording sheets can be obtained. Further, with the blocked color developers of the present invention, the metal salt and leuco dye can be widely selected and, due to reduced coloring in dry state, production of the recording sheet is easy.

What is claimed is:

1. A recording sheet comprising an opaque recording layer containing a color developer of Formula (1) with at least one of phenolic hydroxyl groups having a color-developing function blocked by an O-substituted oxycarbonyl group —(C=O)$OR_1$, and a metal salt of an organic acid or a metal salt of an inorganic acid or a leuco dye reacting with said color developer to develop a color:

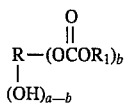

(1)

wherein R denotes a $C_6$ to $C_{30}$-aromatic group, $R_1$ is a $C_1$ to $C_{18}$-alkyl group, $C_3$ to $C_{15}$-cycloalkyl group, $C_1$ to $C_{12}$-halogenated alkyl group, $C_1$ to $C_{12}$-silylalkyl group, vinyl group, allyl group, $C_7$ to $C_{18}$-aryl alkyl group, $C_{13}$ to $C_{25}$-diphenylmethyl group, $C_{19}$ to $C_{35}$-triphenylmethyl group, $C_6$ to $C_{20}$-aryl group, or $C_{10}$ to $C_{20}$-naphthyl group, and a and b are each integers from 1 to 3, and $a \geqq b$.

2. The recording sheet of claim 1 wherein said color developer is of Formula (2) having an electrophilic substitutent or residue having a color developing function, and at least one of the phenolic hydroxyl groups having a color developing function is blocked by an O-substituted oxycarbonyl group:

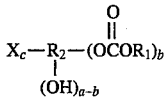

(2)

wherein $R_1$, a and b are the same as those in Formula (1), $R_2$ denotes a $C_6$ to $C_{30}$-aromatic group and c is an integer from 1 to 4, X is halogen atom, nitro group, $C_1$ to $C_{18}$-alkylamino group, $C_1$ to $C_{18}$dialkylamino group, carboxyl group, —C(=O)OY, —C(=O)NHY, or —$SO_2$Y, Y is $C_1$ to $C_{20}$-alkyl group, $C_6$ to $C_{20}$-aryl group, $C_6$ to $C_{30}$-alkoxyaryl group, $C_6$ to $C_{30}$-alkylcarbonyloxyaryl group, or $C_7$ to $C_{18}$-arylalkyl group.

3. The recording sheet of claim 1 wherein said color developer is of Formula (3):

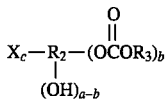

(3)

wherein $R_1$, a and b are the same as those in Formula (1), $R_2$, X and c are the same as those in Formula (2), $R_3$ is tertbutyl group, $C_1$ to $C_6$ alkyl group, benzyl group, p-nitrobenzyl group, α-methylbenzyl group, α, α-dimethylbenzyl group, diphenylmethyl group, triphenylmethyl group.

4. The recording sheet of claim 1 wherein said color developer is of Formula (4) or (5):

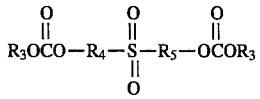

(4)

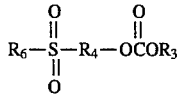

(5)

wherein $R_4$ and $R_5$ denote a $C_6$ to $C_{20}$-aromatic group, and $R_4$ and $R_5$ may be the same or different, $R_3$ is the same as that in Formula (3), $R_6$ denotes a $C_1$ to $C_{18}$-alkyl group, $C_6$ to $C_{30}$-alkylaryl group, $C_6$ to $C_{30}$-alkoxylaryl group, $C_6$ to $C_{30}$-halogenated aryl group, or $C_{10}$ to $C_{30}$-naphthyl group.

5. The recording sheet of claim 1 wherein said color developer is of Formula (6) or (7):

(6)

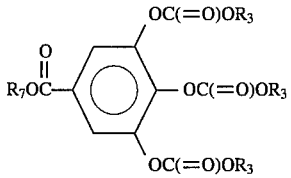

(7)

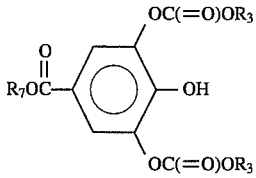

wherein $R_3$ is the same as that in Formula (3), $R_7$ is $C_6$ to $C_{20}$-alkyl group.

6. An optical recording sheet wherein a recording layer of the recording sheet of claim 1 contains a light absorbent for absorbing light and converting it to heat.

7. Recording cards comprising the recording sheet of claim 1, laminated with a plastic film.

8. A recording sheet comprising an opaque recording layer containing a color developer with at least one of phenolic hydroxyl groups having a color-developing function blocked by an O-substituted oxycarbonyl group —(C=O)$OR_1$, and a metal salt of an organic acid or a metal salt of an inorganic acid or a leuco dye reacting with said color developer to develop a color, said color developer having the formula

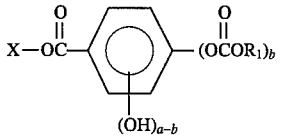

wherein X is $C_3H_6$ or

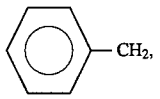

$R_1$ is $C_1$ to $C_4$ alkyl or phenyl, a and b are each integers from 1 to 3, and a≧b.

9. The recording sheet of claim 8 wherein in the color developer formula a is 3 and b is 2 or 3.

10. The recording sheet of claim 8 wherein in the color developer formula X is n-$C_3H_7$ or iso-$C_3H_7$ and $R_1$ is $C_3$–$C_4$ n-alkyl or $C_3$–$C_4$ iso-alkyl.

11. The recording sheet of claim 8 wherein the formula is

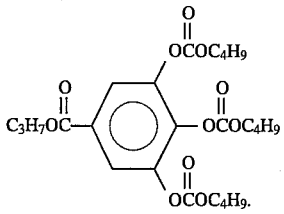

12. The recording sheet of claim 8 wherein the formula is

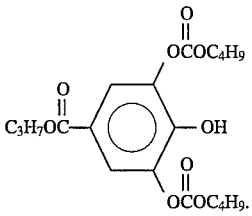

13. The recording sheet of claim 8 wherein the formula is

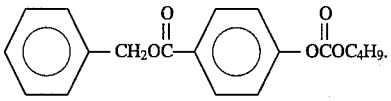

14. A recording sheet comprising an opaque recording layer containing a color developer and a metal salt of an organic acid or a metal salt of an inorganic acid or a leuco dye reacting with said color developer to develop a color, said color developer having the formula

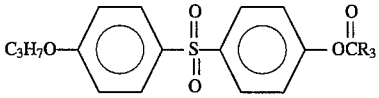

wherein $R_3$ is $C_2$ to $C_6$ alkyl or

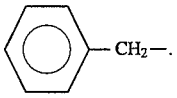

15. A recording sheet comprising an opaque recording layer containing a color developer and a metal salt of an organic acid or a metal salt of an inorganic acid or a leuco dye reacting with said color developer to develop a color, wherein said color developer is a member selected from the group consisting of

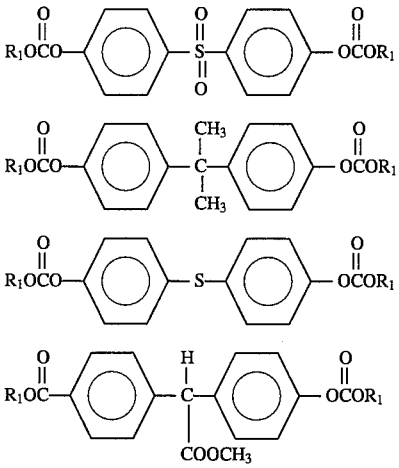

wherein the $R_1$ is $C_2$ to $C_6$ alkyl or phenyl.

16. The recording sheet of claim 15 wherein the color developer has the formula

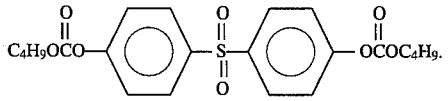
17. The recording sheet of claim 15 wherein the color developer has the formula
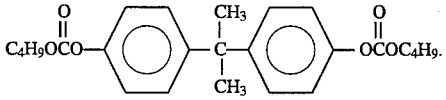
18. The recording sheet of claim 15 wherein the color developer has the formula
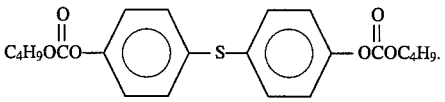
19. The recording sheet of claim 15 wherein the color developer has the formula
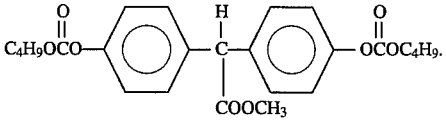
* * * * *